US006045372A

United States Patent [19]

Lian et al.

[11] Patent Number: 6,045,372

[45] **Date of Patent: *Apr. 4, 2000**

[54] CONNECTOR DEVICE AND METHOD FOR MANUFACTURING SAME

[75] Inventors: Loo Giat Lian; Kan Meng Kuang, both of Singapore, Singapore

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/953,885

[22] Filed: Oct. 20, 1997

Related U.S. Application Data

[63] Continuation of application No. 08/374,589, filed as application No. PCT/US93/07335, Aug. 4, 1993, abandoned.

[30] Foreign Application Priority Data

Aug. 6, 1992 [JP] Japan ..... 4-210514

[51] Int. Cl.[7] ..... H01R 9/09

[52] U.S. Cl. ..... 439/83; 439/79; 29/825

[58] Field of Search ..... 439/78–83, 876; 29/825, 874

[56] References Cited

U.S. PATENT DOCUMENTS

| | | | |
|---|---|---|---|
| 2,864,977 | 12/1958 | Witt et al. . | |
| 4,639,056 | 1/1987 | Lindeman et al. | 439/79 |
| 4,695,106 | 9/1987 | Feldman et al. | 439/83 |
| 4,732,565 | 3/1988 | Ito et al. | 439/79 |
| 5,037,316 | 8/1991 | Fukushima et al. | 439/83 |
| 5,076,795 | 12/1991 | Krupp et al. | 439/876 |
| 5,098,311 | 3/1992 | Roath et al. | 439/79 |
| 5,252,080 | 10/1993 | Pesson | 439/79 |
| 5,273,460 | 12/1993 | Arai | 439/79 |
| 5,326,936 | 7/1994 | Taniuchi et al. | 439/876 |
| 5,433,624 | 7/1995 | Tabata | 439/79 |
| 5,647,749 | 7/1997 | Atoh et al. | 439/79 |

FOREIGN PATENT DOCUMENTS

| | | |
|---|---|---|
| 0 204 504 | 12/1986 | European Pat. Off. . |
| 2 666 456 | 3/1992 | France . |
| U-88 11 877 | 11/1988 | Germany . |

*Primary Examiner*—Paul T. Sewell
*Assistant Examiner*—Luan K. Bui
*Attorney, Agent, or Firm*—Woodcock Washburn Kurtz Mackiewicz & Norris LLP

[57] ABSTRACT

A right angle connector device is provided which can hold conductive pins in proper place at a pin-bending step. A plastic housing is molded with a plurality of conductive pins set in and relative to the plastic housing. The respective pins are L-shaped at the time of molding and, after the housing has been molded, have their outer short portions bent in a direction vertical to one surface of the housing. At the bending step, the pins, even if being stressed with a bending force, are rigidly fixed by the surrounding plastic and hence held in proper place in the housing.

14 Claims, 3 Drawing Sheets

CONNECTOR DEVICE AND METHOD FOR MANUFACTURING SAME

This is a continuation of application Ser. No. 08/374,589, filed Jan. 23, 1995 now abandoned, which was the a U.S. filing of National Phase Application Ser. No. PCT/US93/07335 filed Aug. 4, 1993.

BACKGROUND OF THE INVENTION

1. Field of the Invention

The present invention relates to a surface mounting connector device and a method for manufacturing the same and, in particular, to the art of a right angle connector device for surface mounting.

2. Description of the Related Art

Generally, a 2 mm-pitch right angle connector device is manufactured by inserting conductive pins into a once-molded plastics housing and bending their end portions at an angle of 90° with respect to one housing surface. These bent end portions of the pins serve as solder leads and are soldered to lands on an associated printed circuit board.

The connector device manufactured by a method using the pin insertion step is not strong enough to hold the pins in place in the housing and is not stable. At the bending step and subsequent steps, the connector device is not strong enough and rigid rigid to hold the pins in proper place in the housing.

Further, an assembling machine or tooling is required upon insertion of the pins into the housing, thus involving a high manufacturing cost.

SUMMARY OF THE INVENTION

It is accordingly the object of the present invention to provide a connector device and a method for manufacturing the same which can adequately hold pins in a housing and, during a bending process and at a subsequent step, ensure a positive positioning of pins in and relative to the housing.

In one aspect of the present invention, there is provided a connector device comprising:

an elongated housing molded with a resin material and having mutually opposite first and second surface sections and a third surface section to be opposed to a surface of a circuit board in a direction perpendicular to the first and second surface sections and a plurality of first conductive pins and of second conductive pins set in place in and relative to the housing and arranged along a direction parallel to the third surface section at a molding step;

the plurality of first conductive pins being arranged as a single array along a length of the housing, each first conductive pin comprising a vertical portion having one end situated outside the housing and the other end situated inside the housing and vertically extending from its one end side, past the first surface section of the housing, toward its other end side near the second surface section, a parallel portion situated inside the housing and extending from the other end side of the vertical portion toward the third surface section in a direction substantially parallel to the second surface section, and a section projecting, as an extension of the parallel portion, out of the third surface section and bent substantially vertically toward the second surface section along the third surface section to provide a bent portion to be set in contact with a surface of an associated circuit board; and the plurality of second conductive pins being arranged as a single array along a length of the housing in a direction substantially parallel to that in which the plurality of first conductive pins are arranged as a single array, each second conductive pin comprising a vertical portion having one end situated out the housing and vertically extending from its one end side, past the first surface section of the housing, toward its other end side near the first surface section, a parallel portion situated inside the housing and extending from the other end side of the vertical portion toward the third surface section in a direction substantially parallel to the first surface portion, and a portion projecting, as an extension of the parallel portion, out of the third surface section and bent substantially vertically toward the first surface section along the third surface section to provide a bent portion to be set in contact with the surface of the associated circuit board.

According to another aspect of the present invention there is provided a method for manufacturing a connector device, comprising the steps of:

molding an elongated housing with a resin material with a plurality of substantially L-shaped first conductive pins and of substantially L-shaped second conductive pins set in the housing, the housing having mutually opposite first and second surface sections and a third surface section to be opposed to a surface of a circuit board in a direction perpendicular to the first and second surface sections, the plurality of first conductive pins being arranged as a single array along a length of the housing, each first conductive pin having one end outside the housing and other end outside the housing and extending from its other end side, out of the third surface section in a direction vertical to the third surface section and the plurality of second conductive pins being arranged as a single array along the length of the housing in a direction substantially parallel to that in which the first conductive pins are arranged as a single array, each second conductive pin having one end outside the housing and other end outside the housing and extending from its one end side into the housing and projecting, on its other end side, out of the third surface section vertically along the third surface section; and substantially vertically bending the first conductive pin toward the second surface section and the second conductive pin toward the first surface section to provide bent portions to be set in contact with the surface of the circuit board.

According to the present connector device and the present manufacturing method, the housing is molded with a resin with conductive pins set in place in and relative to the resin housing, whereby the conductive pins are fixed by the surrounding resin structure and hence positively held in place in and relative to the resin housing.

DETAILED DESCRIPTION OF THE PREFERRED EMBODIMENTS

Figure 1:
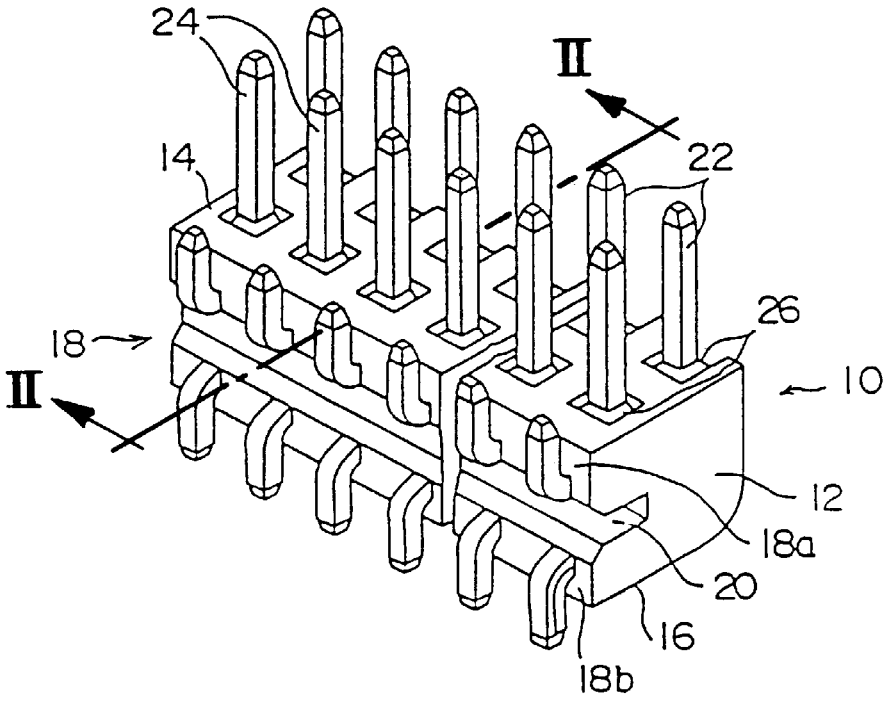
FIG. 1 is a perspective view showing a face mounting connector device according to an embodiment of the present invention.

FIG. 1 shows a first embodiment of the present invention. A right angle connector device 10 of the present invention includes an elongated housing 12 which is injection molded of an insulating resin material, that is, plastics such as PBT, nylon, PPS and PET.

The housing 12 is substantially U-shaped in vertical cross-section and has opposed surface sections 14 and 16, upper and lower, and a side surface section 18 formed perpendicular to the upper and lower surface sections 14 and 16 and to be set opposite a surface of a printed circuit board, not shown.

Preferably, a groove 20 is provided in the side surface section 18 and used to remove a flux, at a time of soldering such as flow soldering or reflow soldering, which causes a defective connection, corrosion and undesirable external appearance if deposited there. The side surface section 18 of the housing 12 is divided by the groove 20 into upper and lower side surface sections 18*a* and 18*b*.

A plurality of first pins 22 and of second pins 24 are set in and relative to the housing 12 upon injection molding of the housing.

Figure 2:
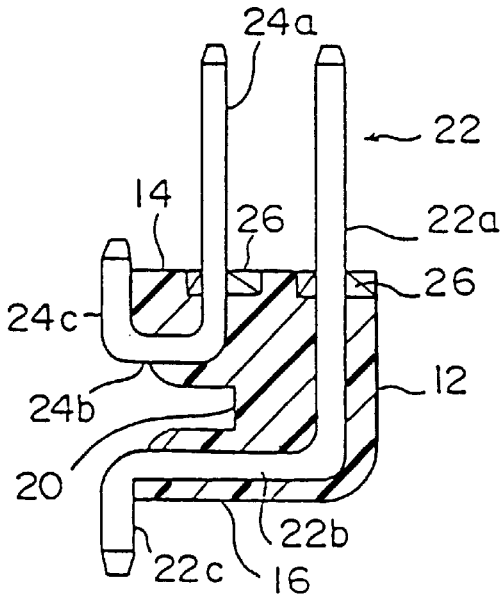
FIG. 2 is cross-sectional view, taken along line II—II in FIG. 1.

The first pin 22 has three continuous portions 22*a*, 22*b* and 22*c* as shown in FIG. 2. The portion 22*a* of the first pin 22 extends, as a vertical portion, from above the upper surface 14 down toward the neighborhood of the lower surface section 16 at an inside area of the housing 12. Inside the housing near the lower surface section 16, the portion 22*b* of the first pin 22 extends, as a parallel portion, from the lower end of the vertical portion 22*a* of the first pin toward the lower side surface section of the housing 12, that is, extends substantially parallel to the lower surface section 16. The portion 22*c*, that is, a bent portion, of the first pin 22 extends, as a soldering lead 22*c*, out of the lower side surface section and is bent downwardly at an angle of nearly 90° relative to the lower surface section 16.

The second pin 24 is substantially J-shaped and has three continuous portions 24*a*, 24*b* and 24*c*. The portion 24*a* of the second pin 24 extends, as a vertical portion, from above the upper surface section 14 of the housing 12 down toward the upper side surface section of the side surface section 18 inside the housing at an area near the upper surface section 14. Inside the housing at an area near the upper surface section 14, the portion 24*b* of the second pin 24 extends, as a parallel portion, from the lower end of the vertical portion 24*a* toward the upper side surface section 18*a* of the housing, that is, extends substantially parallel to the upper surface section 14 of the housing 12. The portion 24*c*, that is, a bent section, of the second pin 24 extends, as a soldering lead 24*c*, upwardly out of the upper side surface section 18*a* of the housing such that the portion 24*c* of the second pin 24 is bent at an angle of nearly 90° relative to the upper surface section 14 of the housing 12.

Figure 3:
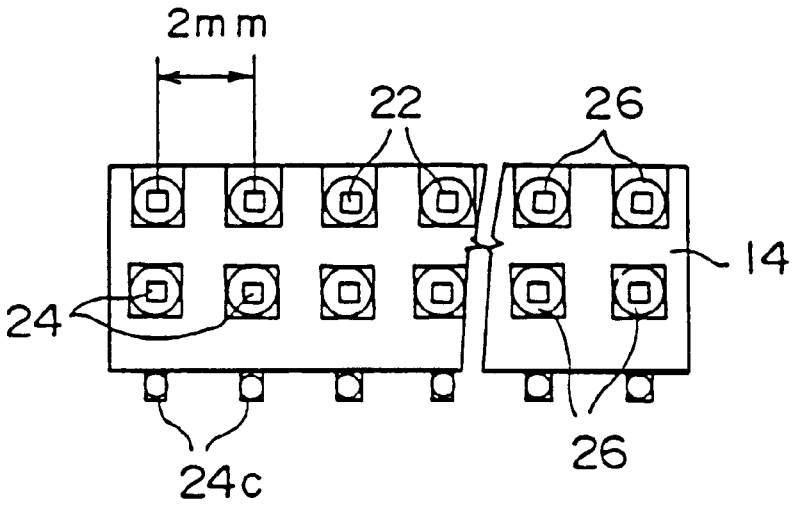
FIG. 3 is a top view showing the connector device shown in FIG. 1.

As shown in FIG. 3, these vertical portions of the first pins 22 are arranged as a single array along the length of the elongated housing 12 such that they extend upwardly relative to the upper surface section 14 of the housing 12. The vertical portions 24*a* of the second pins 24 are arranged as a single array along the length of the housing such that they extend upwardly relative to the upper surface section 14 of the housing. Solder pads 26 are each provided around the corresponding pin (22, 24) at the upper surface section 14 so as to locate the vertical portions 22*a* and 24*a* there. The solder pads 26 in a respective array are arranged at a pitch of 2 mm.

Figure 4:
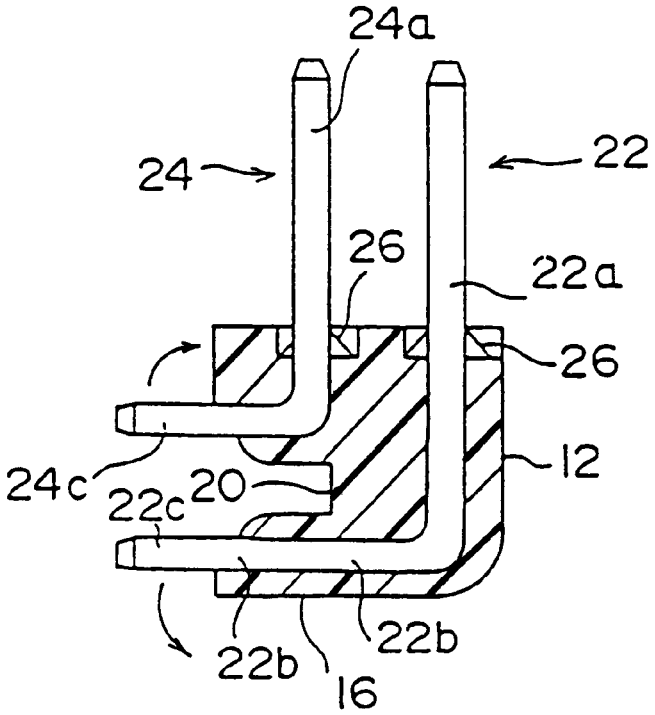
FIG. 4 is a cross-sectional view showing the connector device of FIG. 1 with conductive pins shown in a state before a bending step.
Figure 5:
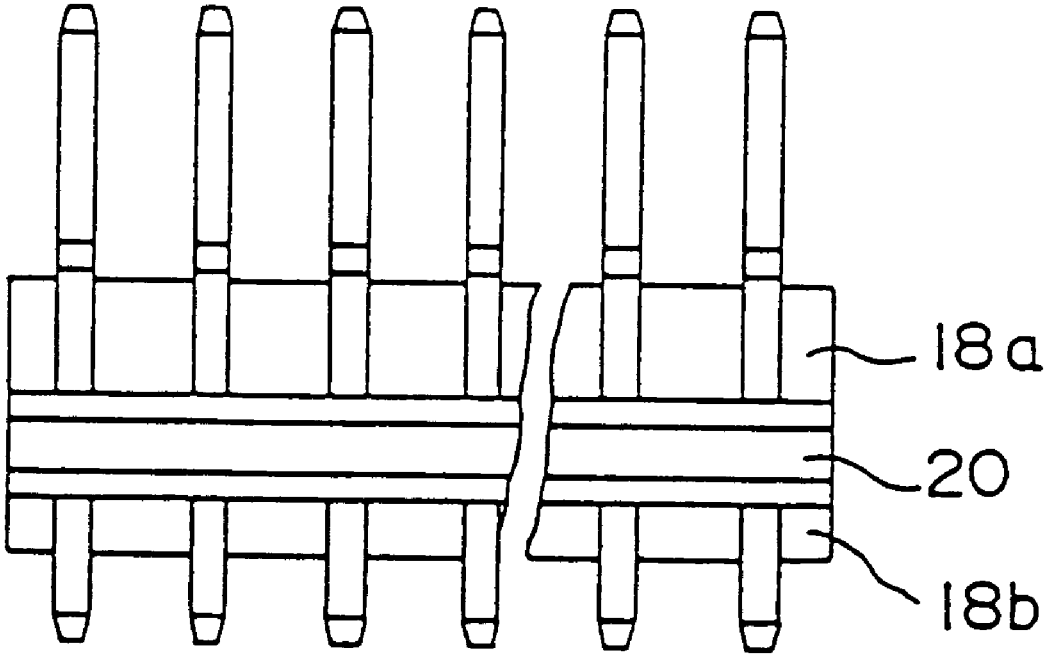
FIG. 5 is a front view showing the connector device of FIG. 1.

As shown in FIG. 4, the first and second pins 22 and 24, upon the injection molding of the housing 12, are set in a substantially L-shape configuration with the portions 22*c* and 24*c* extending, as unbent portions, coaxial with the parallel portions 22*b* and 24*c*, respectively.

As shown in FIGS. 1 to 3 and 5, after the housing has been so injection molded, the unbent portions of the first and second pins are 90° bent as the bent portions 22*c* and 24*c* as already set out above. By so doing, a right angle connector device is manufactured which has solder leads 22*c* and 24*c* to be set opposite the surface of the aforementioned printed circuit board.

The plastics molded with the pins 22 and 24 set as set out above provides, during the pin bending step and subsequent steps, a strength and rigidity enough great to maintain these pins 22 and 24 in proper position. It is thus possible to prevent the pins from being undesirably displaced at the bending step as compared with a conventional right angle connector device of such a type that pins are inserted in the plastics housing once molded.

The right angle connector device of the present invention is face mounted on the circuit board by joining the bent portions 22*c* and 24*c* of the first and second pins 22 and 24, by a reflow soldering for instance, to the corresponding lands on the circuit board with the side surface section 18 of the housing 12 placed opposite the surface of the circuit board. At the soldering step, the groove 20 in the side surface section 18 of the housing defines a clearance relative to the surface of the circuit board, enabling the flux to be removed readily and completely through the groove or the clearance 20.

According to the present connector device as well as the present method, since the resin housing is molded with the pins set in proper place, the pins are rigidly fixed in place by their surrounding resin structure. That is, since the pins can be bent at the bending step relative to the housing such that they are fixed in proper place, it is possible to achieve a high holding force, with which the pins are held in and relative to the housing at the bending step and subsequent steps, and to decrease a stress in the pin-to-housing structure at the time of manufacture.

Further, it is not necessary to assemble pins in the once molded housing or use added tooling relative to that housing so that a tooling cost can be reduced.

What is claimed is:

1. A connector, comprising:

an insulative housing with a first face and a second face substantially perpendicular to said first face; and at least one first conductive element extending through said housing and comprising a mating portion which engages a conductive element of a mating connector, said mating portion comprising a proximal end within said housing and a distal end extending from said first face, a mounting portion extending generally parallel to said second face along an outside of said housing, and a medial portion extending from said second face into said housing and connecting said proximal end of said mating portion and said mounting portion.

2. The connector as recited in claim 1, wherein said mating portion and said mounting portion are substantially parallel.

3. The connector as recited in claim 1, wherein said mating portion and said mounting portion extend from said medial portion in substantially the same direction.

4. The connector as recited in claim 1, wherein said mating portion and said mounting portion extend from said medial portion in substantially opposite directions.

5. The connector as recited in claim 1, wherein said mating portion extends substantially perpendicular from said first face.

6. The connector as recited in claim 1, further comprising at least one second conductive element extending through said housing and comprising a mating portion which engages a conductive element of a mating connector, said mating portion comprising a proximal end within said housing and a distal end extending from said first face, a medial portion connected to said proximal end of said mating portion and extending from said second face of said housing, and a mounting portion extending along an outside of said housing from said medial portion and generally parallel to said second face in a direction along said second face opposite to said at least one first conductive element.

7. A surface mount connector, comprising:

an insulative housing with a first face and a second face substantially perpendicular to said first face and positionable adjacent a surface of a substrate; and at least one first conductive element extending through said housing and comprising a mating portion which engages a conductive element of a mating connector, said mating portion comprising a proximal end within said housing and a distal end extending from said first face, a mounting portion extending generally parallel to said second face along an outside of said housing and receivable along the surface of the substrate, and a medial portion extending from said second face into said housing and connecting said proximal end of said mating portion and said mounting portion.

8. The surface mount connector as recited in claim 7, wherein said mating portion and said mounting portion are substantially parallel.

9. The surface mount connector as recited in claim 7, wherein said mating portion and said mounting portion extend from said medial portion in substantially the same direction.

10. The surface mount connector as recited in claim 7, wherein said mating portion and said mounting portion extend from said medial portion in substantially opposite directions.

11. The surface mount connector as recited in claim 7, wherein said mating portion extends generally parallel to said second face.

12. The surface mount connector as recited in claim 7, further comprising at least one second conductive element extending through said housing and comprising a mating portion which engages a conductive element of a mating connector, said mating portion comprising a proximal end within said housing and a distal end extending from said first face, a medial portion connected to said proximal end of said mating portion and extending from said second face of said housing, and a mounting portion disposed on said outside of said housing and receivable alone the surface of the substrate and extending from said medial portion in a direction alone said second face opposite to said at least one first conductive element.

13. A method of making a connector, comprising the steps of:

molding an insulative housing with a plurality of conductive elements set therein, said insulative housing having a first face and a second face substantially perpendicular to said first face, said conductive elements including: a mating portion which engages a conductive element of a mating connector, said mating portion comprising a proximal end within said housing and a distal end extending from said first face, a mounting portion on an outside of said housing adjacent said second face, and a medial portion extending from said second face into said housing and connecting said proximal end of said mating portion and said mounting portion; and bending said mounting portions of said conductive elements to extend generally parallel to said second face of said insulative housing.

14. The method of making a connector as recited in claim 13, wherein said bending step comprises the steps of:

bending a portion of said mounting portions of said conductive elements generally parallel to and in a direction along said second face of said insulative housing; and bending another portion of said mounting portions of said conductive elements generally parallel to and in an opposite direction along said second face of said insulative housing.

* * * * *